US010105739B2

(12) United States Patent
Burkhard

(10) Patent No.: US 10,105,739 B2
(45) Date of Patent: Oct. 23, 2018

(54) SPRAYING DEVICE

(71) Applicant: Juergen Burkhard, Kaufbeuren (DE)

(72) Inventor: Juergen Burkhard, Kaufbeuren (DE)

( * ) Notice: Subject to any disclaimer, the term of this patent is extended or adjusted under 35 U.S.C. 154(b) by 0 days.

(21) Appl. No.: 15/016,618

(22) Filed: Feb. 5, 2016

(65) Prior Publication Data

US 2016/0228931 A1 Aug. 11, 2016

(30) Foreign Application Priority Data

Feb. 6, 2015 (DE) ..... 10 2015 001 534

(51) Int. Cl.

| | |
|---|---|
| ***B08B 9/093*** | (2006.01) |
| ***B05B 13/02*** | (2006.01) |
| ***B05B 1/14*** | (2006.01) |
| ***B05B 3/04*** | (2006.01) |
| ***B05B 13/06*** | (2006.01) |
| ***B05B 15/656*** | (2018.01) |

(52) U.S. Cl.

CPC ..... *B08B 9/093* (2013.01); *B05B 1/14* (2013.01); *B05B 3/0404* (2013.01); *B05B 13/0278* (2013.01); *B05B 13/0627* (2013.01); *B05B 15/656* (2018.02)

(58) Field of Classification Search

CPC ..... B08B 9/093; B05B 1/14; B05B 13/0278; B05B 3/0404; B05B 13/0627; B05B 15/656

See application file for complete search history.

(56) References Cited

U.S. PATENT DOCUMENTS

| | | | | |
|---|---|---|---|---|
| 909,654 A | | 1/1909 | Oliver | |
| 1,895,890 A | | 1/1933 | Meng | |
| 3,117,584 A | | 1/1964 | Elenbaas | |
| 3,719,191 A | | 3/1973 | Zimmerly | |
| 3,856,570 A | * | 12/1974 | McDermott | B08B 9/093 134/167 R |

(Continued)

FOREIGN PATENT DOCUMENTS

| | | |
|---|---|---|
| DE | 7247130 U | 12/1972 |
| DE | 2436432 | 1/1976 |

(Continued)

OTHER PUBLICATIONS

German Search Report prepared by the German Patent Office dated Dec. 16, 2015, for German Application No. 10 2015 001 534.6.

(Continued)

*Primary Examiner* — Michael Barr
*Assistant Examiner* — Benjamin L Osterhout
(74) *Attorney, Agent, or Firm* — Sheridan Ross P.C.

(57) ABSTRACT

A spraying device according to the invention, in particular, for low-pressure internal cleaning of containers, comprises:

Figure 1:
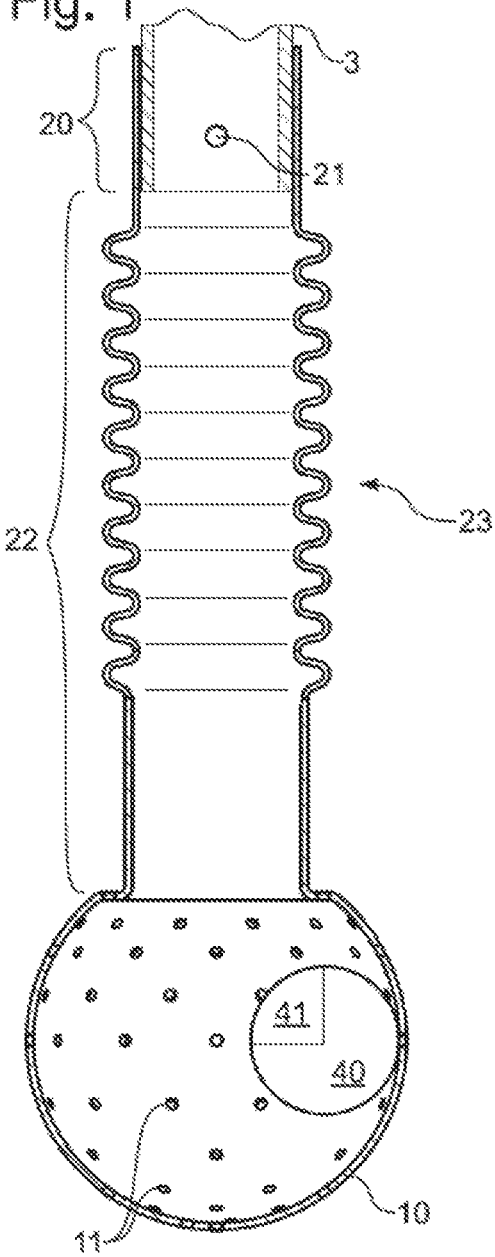

a, in particular, spherical, hollow spray head having a plurality of spray openings;

a junction for fastening to a fluid connection, in particular, in a form-fitted, friction-locked, and/or substance-bonded manner; and a connecting tube that connects the spray head to the junction; wherein:

the connecting tube comprises at least one elastic hinge section through which the spray head is mounted so as to be elastically movable relative to the junction; and/or a, in particular, spherical perturbation body is accommodated so as to be able to move within the hollow spray head.

20 Claims, 1 Drawing Sheet

(56) References Cited

U.S. PATENT DOCUMENTS

| | | | | |
|---|---|---|---|---|
| 4,173,308 | A | 11/1979 | Savvides | |
| 4,711,259 | A * | 12/1987 | Martin, Jr. | B08B 9/093 134/166 R |
| 5,316,218 | A * | 5/1994 | Bowen | B05B 3/06 239/246 |
| 5,497,799 | A * | 3/1996 | Shenk | B05B 3/066 134/167 R |
| 2002/0069897 | A1* | 6/2002 | Emrey | B08B 9/093 134/22.18 |
| 2003/0137895 | A1* | 7/2003 | Hummer | B01F 5/0218 366/137 |
| 2003/0145880 | A1* | 8/2003 | Jepsen | B08B 9/0936 134/167 R |
| 2007/0221251 | A1* | 9/2007 | Gregory | B60S 3/008 134/22.18 |
| 2010/0051057 | A1* | 3/2010 | Delaney | B05B 13/0636 134/10 |
| 2010/0213277 | A1* | 8/2010 | Bowen | B05B 3/06 239/261 |
| 2011/0017304 | A1 | 1/2011 | Babl et al. | |
| 2013/0333732 | A1 | 12/2013 | Kaske | |

FOREIGN PATENT DOCUMENTS

| | | | |
|---|---|---|---|
| DE | 8812568 | | 1/1989 |
| DE | 19526404 | | 7/1995 |
| DE | 19526404 | A1 | 7/1995 |
| DE | 102009001396 | | 9/2010 |
| DE | 102209001396 | A1 | 9/2010 |
| WO | WO 2009/112446 | A1 | 9/2009 |

OTHER PUBLICATIONS

Extended Search Report for European Patent Application No. 16000194.7, dated Jun. 3, 2016, 11 pages.

* cited by examiner

SPRAYING DEVICE

CROSS REFERENCE TO RELATED APPLICATIONS

This application claims the benefit of German Patent Application No. 10 2015 001 543.6 filed Feb. 6, 2015, the disclosure of which is incorporated herein by reference in its entirety.

DESCRIPTION

The present invention relates to: a spraying device, in particular, for low-pressure internal cleaning of containers; a container, in particular, a tank, in particular, for food and/or consumables, chemicals, and/or lubricants and/or fuels, that comprises the spraying device; a mobile cleaning assembly that comprises the spraying device; and a method for internally cleaning a container, in particular, a tank, in particular, for food and/or consumables, chemicals, and/or lubricants and/or fuels.

Known proprietary practices include spraying devices comprising: a spherical, hollow spray head having a plurality of spray openings; a junction that is fastened to a fluid connection; and a single-piece, rigid connecting tube that rigidly connects the spray head to the junction.

Due to the spray head being stationary relative to the junction or the container, jets from the spray openings substantially always strike the same place on a container requiring internal cleaning, such that the container is flushed in an uneven manner.

Known proprietary practices thus have also entailed a spraying device with which the spray head is rotatably/movably mounted by means of a rigid body joint, e.g., a hinge joint or ball joint, with which joint surfaces, e.g., of a shaft and pins of a hinge joint or a cap and ball of a ball joint, slide over one another.

The present invention addresses the problem of improving a spraying device and/or internal cleaning of containers.

This problem is solved by a spraying device having the features of claim 1. Clams 13-15 seek protection for a container having a spraying device described herein, a mobile cleaning assembly having a spraying device described herein, a method for internally cleaning a/the container having a spraying device described herein, and a cleaning assembly. The dependent claims relate to advantageous developments.

According to one aspect of the present invention, a spraying device comprises a hollow spray head having a plurality of spray openings, a junction for fastening to a fluid connection, and a connecting tube that connects the spray head to the junction. In one embodiment, the connecting tube comprises one or more elastic hinge sections through which the spray head is elastically movable (movably mounted) relative to the junction, Additionally or alternatively, one or a plurality of perturbation bodies is/are movably accommodated within the hollow spray head.

Surprisingly, it has been found that already, per se, elastic mobility or mounting of the spray head with respect to or relative to the junction through at least one elastic hinge section of the connecting tube on one side and through at least one mobile perturbation body in the spray head on the other side makes it possible to realize advantageous flushing, in particular due to the fact that the elastically mobile or mounted spray head or the perturbation body/bodies in the spray head excited to move by fluid flowing through the spraying device.

In one embodiment, the spray head is formed so as to be spherical. In one embodiment, spray openings are arranged in a half that faces the junction or a half that faces away from the junction. In one embodiment, spray openings comprise one at least essentially circular, slot-shaped, or slit-shaped cross-section.

The junction is or has been rendered able to be fastened, or, in particular, is or has been fastened or is set up for this purpose to the fluid connection, in particular, through corresponding fittings, holes, or the like in: a form-fitted manner, in particular, through one or more split pins end/or a bayonet fitting; a friction-locked manner, in particular, through one or more brackets and/or an internal or external thread of the junction; and/or substance-bonded manner, in particular, through welding, soldering, and/or gluing.

In one embodiment, no (rigid body) joint having joint surfaces that slide over one another, and, in particular, no hinge joint or ball joint, is arranged between the spray head and the junction. The mobility of the spray head with respect to the junction is effected in this embodiment exclusively by the elastic hinge section(s), thus making it possible to advantageously avoid soiling of fluid flowing through the spraying device and/or of the container interior due to abrasion and/or lubricants of rigid body joint surfaces, and/or soiling of such joint surfaces, in particular, bacterial attack thereof.

In another embodiment, one or more (rigid body) joints having joint surfaces that slide over one another, in particular, one or more hinge joints or ball joints is/are arranged between the spray head and the junction, This makes it possible to advantageously and especially optionally endow the spray head with greater mobility relative to the junction. In one embodiment, one or more (rigid body) joints arranged between the spray head and the junction can be locked, such that when the (rigid body) joint(s) is/are locked, the mobility of the spray head with respect to the junction is in turn solely effected through the elastic hinge section(s).

In one embodiment, one, in particular, the only one, or more elastic hinge sections may each comprise or in particular be one or more local diameter enlargements and/or one or more local diameter reductions, in particular, bellowing having at least, in particular, at least five folds. Such local diameter enlargements and/or diameter reductions, in particular, folds make it possible, in one embodiment, to impart an advantageous elastic mobility and/or excite elastic mobility in the spray head in an fluidically advantageous manner.

Additionally or alternatively, in one embodiment, one, in particular, the only one, or more elastic hinge sections may each comprise one or more elastic membranes, in particular, ring membranes, wherein, in one embodiment, a ring membrane of the connecting tube is arranged between a rigid tube section of the connecting tube and the spray head, in particular, connects them, and/or a ring membrane is arranged between two rigid tube sections of the connecting tube, in particular, connects them to one another. A ring membrane between a rigid tube section of the connecting tube and the junction makes it possible to effect elastic mobility of the tube section with respect to or relative to the junction, while a ring membrane between a rigid tube section of the connecting tube and the spray head makes it possible to effect elastic mobility of the spray head with respect to or relative to the tube section, and a membrane between two rigid connecting tube sections makes it possible to effect elastic mobility of these rigid connecting tube sections with respect to or relative to one another.

Additionally or alternatively, in one embodiment, one, in particular, the only one, or more elastic hinge sections may each have a wall thickness, in particular, a maximum or mean wall thickness, of at most 0.9 mm, in particular, at most 0.8 mm, in particular, at most 0.7 mm. In one embodiment, a bellows has such a wall thickness. Similarly, also, a cylindrical connecting tube which has a constant cross-section in one embodiment may have such a wall thickness over the entire axial length thereof, or a portion thereof, and thus form an elastic hinge section in the sense of the present invention. Such a wall thickness makes it possible to impart and advantageous elastic mobility in one embodiment.

Additionally or alternatively, in one embodiment, one, in particular, only one, or more elastic hinge sections may each have an elastic modulus of at most 10 GPa, in particular, at most 7 GPa. Such a low(er) stiffness makes it possible to impart an advantageous elastic mobility in one embodiment.

Additionally or alternatively, in one embodiment, one, in particular, the only one, or more elastic hinge sections may each comprise or, in particular, be composed of plastic, in particular elastomer, and/or metal, in particular a steel alloy or light metal alloy, in particular with aluminum and/or titanium. Such a material makes it possible to impart an advantageous elastic mobility in one embodiment.

In one embodiment, one, in particular, the only one, or more elastic hinge sections and the spray head are produced from the same material. Additionally or alternatively, one, in particular, the only one, or more elastic hinge sections and the junction are produced from the same material. In another embodiment, one, in particular, the only one, or more elastic hinge sections and the spray head are produced from different materials, and/or one, in particular, the only one, or more elastic hinge sections and the junction are produced from different materials.

In one embodiment, the connecting tube and the spray head are detachably connected to one another, in particular, in: a form-fitted manner, in particular, through one or more split pins and/or a bayonet fitting; and/or a friction-locked manner, in particular, through one or more brackets and/or a threading of the junction; or substance-bonded manner, in particular, through welding, soldering, and/or gluing. Alternatively, the connecting tube and the spray head are integrally formed together.

In one embodiment, one, in particular, the elastic hinge section extends over at most 90%, in particular, at most 75% of an axial length of the connecting tube and/or an axial distance between the junction and the spray head. Additionally or alternatively, one section, in particular, the elastic hinge section extends over at least 10%, in particular, at least 25% of the axial length of the connecting tube and/or an axial distance between the junction and the spray head. As stated above, in one embodiment, the complete connecting tube may also form an or the elastic hinge section as a whole, in particular, as a result of a corresponding wall thickness and/or corresponding elastic modulus, in particular, of the material.

In one embodiment, one or more perturbation bodies have one or more surface depressions and/or one or more flat surface regions, e.g., notches, (helical) blades, or the like. This makes it possible to improve the perturbing or (out) flow-heterogenizing action in one embodiment. In one embodiment, one, in particular, the only one, or more perturbation bodies is/are formed so as to be spherical. In one embodiment, a perturbation body may be a hollow or solid body, in particular, one made of metal, ceramic. Teflon, and/or plastic.

In one embodiment, a maximum outer diameter of a perturbation body is at most 90% of a minimum inner diameter of the connecting tube, and/or at most 75%, in particular, at most 50% of a minimum inner diameter of the hollow spray head. This makes it possible to improve the perturbing or (out)flow-heterogenizing action in one embodiment.

According to one aspect of the present invention, a container, in particular, a tank, in particular, for food and/or consumables such as beverages, spices, tobacco, or the like, chemical and/or lubricants and/or fuels comprises a fluid connection, in particular, one that is nozzle-shaped or hole shaped, as well as an above-described spraying device, the junction thereof being fastened to the fluid connection.

In one embodiment, the junction comprises or, in particular, is a tube, in particular, a tube (end) region, which may be formed in one embodiment so as to be rigid and/or integral, in particular, homogeneous, with the connecting tube, or may connect thereto in a seamless and transition-free manner. In other words, a (rigid and/or end) region of a tube, in particular, one that overlaps with the fluid connection or is provided for this purpose, may form a junction in the sense of the present invention, which the remaining tube forming a connecting tube in the sense of the present invention. In one embodiment, the junction comprises or, in particular, is an end of the connecting tube.

In one embodiment, the spraying device comprises a tube having a first and second end, wherein the first end is fastened to the spray head. In one embodiment, the junction is formed by an end region of the tube, which extends in one embodiment over at most 25%, in particular, at most 10% of an axial length of the tube between the first and second ends thereof and comprises the second end—in particular, the second end—and the remaining tube forms the connecting tube.

Similarly, in one embodiment, the junction may be, in particular, even a region, in particular, an edge of a (ring) membrane, which comprises, or, in particular, is, an elastic hinge section of the connecting tube.

According to one aspect of the present invention, a container described herein is cleaned internally by when cleaning fluid is supplied via the junction, in particular, at a pressure of at most 5 bar, in particular, at most 3 bar, the cleaning fluid flowing through the spraying device and emerging from the spray openings, in order to internally clean the container. If the cleaning fluid is supplied at a pressure of at most 3 bar, then this is designated as low-pressure internal cleaning in the sense of the present invention.

According to one aspect of the present invention, a mobile cleaning assembly, in particular, for low-pressure internal cleaning of a cleaner, in particular, a tank, in particular, for food and/or consumables such as beverages, spices, tobacco, or the like, chemical and/or lubricants and/or fuels comprises a fluid connection and an above-described spraying device, the junction thereof being able to be fastened or, in particular, having been fastened to the fluid connection in a form-fitted, friction-locked, and/or substance-bonded manner.

The mobile cleaning assembly may, in particular, comprise a passive, unpowered, actuated, driven, or, in particular, motorized chassis having one or more wheels, crawlers, or the like, on which chassis the fluid connection can be arranged so as to be rigid or movable, or, in particular, articulated. Such a mobile cleaning trolley can be arranged, in particular, temporarily or permanently in the container, and/or operated therein. In one embodiment, the fluid connection thereof can be connected or, in particular, has been connected to a fluid reservoir, in particular, one that is fixed to be chassis or is external, in particular, by means of a hose.

According to one aspect of the present invention, the container is internally cleaned by means of the mobile cleaning assembly, by which cleaning fluid is supplied via the junction, in particular, at a pressure of at most 5 bar, in particular, at most 3 bar, the cleaning fluid flowing through the spraying device and emerging from the spray openings in order to internally clean the container.

In one embodiment, the spray head of an above-described spraying device connected to one or more additional spray heads, in particular, to a spray head of one or more additional above-described spraying devices, so as to be fluidically parallel or in series.

In particular, in one embodiment, the spray head of an above-described spraying device may in turn comprise at least one fluid connection, in particular, that is nozzle-shaped or hole shaped, to which an additional spray head can be fastened or, in particular, has been fastened, in particular, via a connecting tube. In one embodiment, the spray head of an above-described spraying device may in turn comprise at least one fluid connection to which a junction of at least one additional one of the above-described spraying devices can be fastened or, in particular, has been fastened.

Additionally or alternatively, in one embodiment, the junction of an above-described spraying device may be able to be fastened or, in particular, may have been fastened to a fluid connection, in particular, that is nozzle-shaped or hole-shaped, the fluid connection belonging to an additional spray head, in particular, a spray head of an additional one of the above-described spraying devices.

Figure 2:
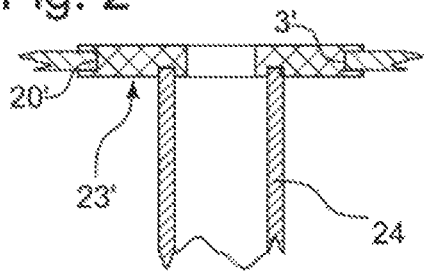

Further advantages and features shall arise from the dependent claims and the embodiments, For this purpose, the drawings provide a partially schematic depiction:

FIG. 1 illustrates a sectional view of a spraying device according to an embodiment of the present invention; and FIG. 2 illustrates a partial sectional view of a container having a spraying device according to another embodiment of the present invention.

FIG. 1 illustrates a sectional view of a spraying device for low-pressure internal cleaning of a container according to one embodiment of the present invention, comprising: a spherical, hollow spray head 10 having a plurality of spray openings 11; a junction 20, which can be or has been fastened by means of a split pin (not shown) to a nozzle-shaped fluid connection 3 of the container that penetrates through a corresponding hole 21; and a connecting tube 22, which connects the spray head 10 to the junction 20.

In the embodiment, the junction 20 is formed by an end region of a tube 20+22, which is upper in FIG. 1 and penetrates through the fluid connection 3, and the remaining tube, which is thus homogeneously formed, forms the connecting tube 22 in the sense of the present invention.

This connecting tube 22 comprises an elastic hinge section in the form of a bellows, which has a plurality of local diameter enlargements and diameter reductions in the form of folds 23, the spray head 10 being mounted through the hinge section so as to be elastically movable relative to the junction 20.

A spherical perturbation body 40 is accommodated so as to be able to move within the hollow spray head 10.

No rigid body joint having joint surfaces that slide over one another is arranged between the spray head 10 and the junction 20.

The elastic hinge section—in the form of the bellows comprising a plurality of folds 23—has a wall thickness of between 0.6 and 0.8 mm.

In the embodiment, the spray head 10 and the connecting tube are produced from a metal, in particular, an aluminum alloy, and are connected by being substance-bonded to one another. In one variation, the spray head 10 and/or the connecting tube 22 may also be produced from plastic, in particular, integrally with one another, such that the elastic hinge section in the form of the bellows having a plurality of folds 23 has an elastic modulus of at most 7 GPa in one embodiment.

The elastic hinge section in the form of the bellows having a plurality of folds 23 extends in the embodiment over at most 75% and at least 25% of an axial length of the connecting tube 22.

The perturbation body comprises a surface depression having flat surface regions in the form of a notch 41. The (maximum) outer diameter thereof is at most 90% of a minimum inner diameter of the connecting tube, and/or at most 75%, in particular, at most 50% of a minimum inner diameter of the hollow spray head.

In order to internally clean the container, cleaning fluid at a pressure between 1 and 2.5 bar is supplied via the junction 20, flows through the spraying device, and exits from the spray openings 11, in order to internally clean the container.

FIG. 2 illustrates a partial sectional view of a container having a spraying device according to another embodiment of the present invention.

With this embodiment, the elastic hinge section is formed as an elastic ring membrane 23', made out of an elastomer, an edge 20' thereof being connected to a hole-shaped fluid connection 3' of the container (in a manner that is only schematically depicted) and thus forming a junction in the sense of the present invention. At the inner periphery thereof, the ring membrane 23' is in turn connected (in a manner that is only schematically depicted) to a rigid tube 24 that thus forms, together with the ring membrane 23, a connecting tube in the sense of the present invention. A spray head, as explained with reference to FIG. 1, is fastened in a substance-bonded manner to the end facing away from the junction (bottom in FIG. 2).

The ring membrane 23' is thus arranged between the rigid tube (section) 24 of the connecting tube and the junction 20'. In one variation (not shown), a ring membrane may analogously be arranged between the rigid tube section 24 of the connecting tube and the spray head.

Though the preceding description explains exemplary embodiments, it should be noted that a variety of variations are also possible. It should also be noted that the exemplary embodiments merely involve examples that are not intended to limit the scope, applications, or structure in any way. Instead, the preceding description offers a person skilled in the art a guide for implementing at least one exemplary embodiment, wherein diverse modifications may be made, in particular, as regards the function and arrangement of the components described, without departing from the scope as is set forth in the claims and these equivalent combinations of features.

REFERENCE NUMERAL LIST

10 Spray head
11 Spray openings
20; 20' Junction
21 Hole
22 Connecting tube

23 (Bellows having a plurality of) fold(s)
23' Ring membrane
24 Tube (section)
3; 3' Fluid connection
40 Perturbation body
41 Notch

What is claimed is:

1. A spraying device comprising:
a hollow spray head having a plurality of spray openings;
a junction for fastening to a fluid connection; and
a connecting tube that connects the spray head to the junction;
wherein the connecting tube comprises at least one elastic hinge section through which the spray head is mounted so as to be elastically moveable relative to the junction;
wherein the elastic hinge section comprises
at least one local diameter enlargement and at least one local diameter reduction; and
the spraying device further comprising a perturbation body that is accommodated within the hollow spray head so as to be able to move within the hollow spray head.

2. The spraying device according to claim 1, wherein the spraying device is devoid of a joint positioned between the spray head and the junction.

3. The spraying device according to claim 1, wherein the elastic hinge section has a wall thickness of at most 0.9 mm.

4. The spraying device according to claim 1, wherein the elastic hinge section has an elastic modulus of at most 10 GPa.

5. The spraying device according to claim 1, wherein the elastic hinge section is comprised of at least one of plastic and metal.

6. The spraying device according to claim 1, wherein the elastic hinge section and the spray head are produced from the same material and/or the elastic hinge section and the junction are produced from the same material.

7. The spraying device according to claim 1, wherein the elastic hinge section extends over at most 90% or at least 10% of an axial length of the connecting tube.

8. The spraying device according to claim 1, wherein the perturbation body comprises at least one of a surface depression and a flat surface region.

9. The spraying device according to claim 1, wherein a maximum outer diameter of the perturbation body is at least one of at most 90% of a minimum inner diameter of the connecting tube and at most 75% of a minimum inner diameter of the hollow spray head.

10. The spraying device of claim 1, wherein the hollow spray head is spherical.

11. The spraying device of claim 1, wherein the at least one local diameter enlargement and the at least one local diameter reduction form a bellows having at least two folds.

12. The spraying device of claim 1, wherein the perturbation body is spherical.

13. The spraying device of claim 1, wherein the junction is for fastening to the fluid connection in a form-fitted, friction-locked, and/or substance-bonded manner.

14. The spraying device of claim 1, wherein the elastic hinge section further comprises at least one elastic membrane.

15. The spraying device according to claim 14, wherein the at least one elastic membrane comprises a ring membrane that is arranged between one of a rigid tube section of the connecting tube and the junction, the rigid tube section of the connecting tube and the spray head, and two rigid tube sections of the connecting tube.

16. The spraying device of claim 14, wherein the elastic membrane is a ring membrane.

17. A container comprising the fluid connection and the spraying device according to claim 1, the junction thereof being fastened to the fluid connection.

18. A method for internally cleaning the container according to claim 17, wherein cleaning fluid is supplied via the junction and exits from the spray openings in order to internally clean the container.

19. A mobile cleaning assembly for internal cleaning of a container comprising the fluid connection and the spraying device according to claim 1, the junction thereof being able to be fastened to the fluid connection.

20. A method for internally cleaning a container by the cleaning assembly according to claim 19, wherein cleaning fluid is supplied via the junction and exits from the spray openings in order to internally clean the container.

* * * * *